US011944134B2

(12) United States Patent
Desmeules

(10) Patent No.: US 11,944,134 B2
(45) Date of Patent: Apr. 2, 2024

(54) ARTICLE OF WARMTH WITH INTEGRATED AND CONCEALED BATTERY RETENTION POCKET

(71) Applicant: Brooke Erin DeSantis, Montreal (CA)

(72) Inventor: Alain Desmeules, Montreal (CA)

(73) Assignee: Brooke Erin De Santis, Quebec (CA)

( * ) Notice: Subject to any disclaimer, the term of this patent is extended or adjusted under 35 U.S.C. 154(b) by 196 days.

(21) Appl. No.: 17/690,050

(22) Filed: Mar. 9, 2022

(65) Prior Publication Data

US 2023/0284712 A1 Sep. 14, 2023

(51) Int. Cl.
*A41D 13/005* (2006.01)
*A41D 27/20* (2006.01)

(52) U.S. Cl.
CPC ..... *A41D 13/0058* (2013.01); *A41D 27/20* (2013.01)

(58) Field of Classification Search
CPC ..... A41D 13/0058; A41D 27/20
USPC ..... 2/102, 250
See application file for complete search history.

(56) References Cited

U.S. PATENT DOCUMENTS

| | | | | |
|---|---|---|---|---|
| 4,106,121 | A | 8/1978 | Belson | |
| 4,241,459 | A | 12/1980 | Quayle | |
| D316,472 | S | 4/1991 | Flanagan | |
| 5,024,360 | A | 6/1991 | Rodriguez | |
| 5,211,321 | A | 5/1993 | Rodriguez | |
| D357,342 | S | 4/1995 | Gelinas | |
| 5,564,124 | A * | 10/1996 | Elsherif | A41D 13/0025 2/457 |
| 5,572,401 | A | 11/1996 | Carroll | |
| 5,617,582 | A | 4/1997 | Burwell | |
| 6,874,163 | B2 | 4/2005 | Marshall | |
| 8,105,371 | B1 | 1/2012 | Giocondo, Jr. | |
| 8,793,815 | B1 | 8/2014 | Kelley-Mozsy | |
| 8,876,875 | B1 * | 11/2014 | Nilforushan | A61H 1/008 607/108 |
| 2006/0213895 | A1 * | 9/2006 | Dennis | A41D 13/0051 219/211 |
| 2017/0013890 | A1 * | 1/2017 | Byrne | A41D 27/201 |

(Continued)

FOREIGN PATENT DOCUMENTS

WO WO-2018178618 A1 * 10/2018 ..... A41D 13/0058

*Primary Examiner* — Tajash D Patel
(74) *Attorney, Agent, or Firm* — Guy J. Houle; HOULE PATENT ANGENCY INC.

(57) ABSTRACT

An electrically heated article of warmth adapted to generate heat to a user person's body. The article of warmth has at least one integrally formed pocket to support and conceal one or more batteries at desired locations and orientations therein for the comfort of the user person. The pocket is formed between opposed fabric materials to define a hollow concealed pocket space. An opening is formed in one of the opposed fabric materials for access to the hollow concealed pocket space. The opposed fabric materials have an inner surface facing one another in the hollow concealed pocket space. The inner surfaces have sticky materials which when the inner surfaces are placed against one another they exhibit a binding retention force. The one or more batteries are retained at the desired locations and orientations by the retention force of the of the inner surface of the opposed fabric materials being placed in contact with one another. In one embodiment, only one of the inners surfaces has a sticky material and the batteries are provided with a further sticky material to bind to the inner surface.

31 Claims, 8 Drawing Sheets

(56) References Cited

U.S. PATENT DOCUMENTS

| | | | | |
|---|---|---|---|---|
| 2018/0228226 | A1* | 8/2018 | Corcoran | A41D 31/18 |
| 2018/0338549 | A1* | 11/2018 | Orr | H05B 3/36 |
| 2021/0186749 | A1* | 6/2021 | Kates | A61F 7/02 |
| 2023/0208114 | A1* | 6/2023 | Thiel | H01M 50/548 429/129 |

* cited by examiner

ARTICLE OF WARMTH WITH INTEGRATED AND CONCEALED BATTERY RETENTION POCKET

FIELD OF THE INVENTION

The present invention relates to heated articles of warmth which are electrically heated and more specifically to such articles having battery retention pockets are to support batteries. Specifically, the present invention pertains to such electrically heated articles of warmth formed with one or more large integrally formed concealed pocket(s) having one or opposed internal binding surfaces permitting the batteries to be positioned and retained therein at desired locations to provide comfort to the user person in a simple and in a user-friendly way and which is more comfortable and safer for the user person.

BACKGROUND OF THE INVENTION

It is well known in the art to provide articles of warmth, such as jackets and vest, for example, with one or several pockets formed on its outer surfaces to support batteries therein to provide power to heating wire patterns permanently secured inside the fabrics of the article. In each of the pockets there is also provided an electrical conductor with a connector plug to connect and disconnect the battery form the heating wire circuit. These pockets are usually small in size and can usually accommodate only one battery. Therefore, if there are several heating wire circuits there may be several pockets to support batteries to power different circuits. This is inconvenient to the user person and to the fabricator of such articles of apparel due to the fabrication of many pockets and the securement of wires and connectors thereto increasing the risk or malfunction due to defects in the manufacture. The location of these pockets can also be uncomfortable to the user person depending on ones activities, such as a job function or a sport activity. These pockets are also dimensioned to receive a specific size of battery, which also limits the type of battery that can be utilized. These pouches mounted on the external surface of the article of warmth can also be unpleasant to the design appearance of the article. Still further, the weight distribution of the batteries due to the location of the pockets may cause a discomfort to the user person depending of its physiognomy.

It is also known in the art to provide battery support harnesses secured to a person's body under an article of apparel to support batteries at various locations to distribute the weight of the battery load, for example a battery belt wherein several batteries are positioned about the waist of the user person and concealed from view. However, such is uncomfortable to different parts of the body and is bulky and very uncomfortable to a wearer person when concealed under an article of apparel. It is also a different article worn under an article of apparel equipped with heating wires and requiring connection thereto. Further, the wearer person cannot displace the location of the batteries as pockets are not displaceable. It is also known to provide a vest capable of supporting thermal packets at different locations against a person's body to provide warmth to targeted areas of the body, see U.S. Pat. No. 8,105,371, issued Jan. 31, 2012 and entitled Comfort Enhancing Vest System. This patent disclosed the connection of VELCRO, Registered trademark, strips in parallel pairs and oriented vertically at different locations of a vest. These strips may comprise the loops material. The Thermal packets are also provided with parallel pairs of VELCRO strips, herein the hooks, and oriented in parallel pairs and disposed transversely. Accordingly, the position of the packets are adjustably positioned to a desired location to provide heat to a different part of a wearer person's body. Such vest, however, possess several of the disadvantages mentioned herein above, such as being visible, uncomfortable due to the stiffness of the Velcro material and bulky, particularly when worn under a jacket article of apparel. Velcro is made out of plastic and unfriendly to the environment and the hook side is very abrasive and known to be ripping the fabrics surrounding or touching it. These harnesses are also not pleasant to the touch or to the eye. For example, if a wearer person wished to carry a backpack of its back, such would make it very uncomfortable or impossible to do so. It is also an added cost has it is not prat of an outerwear. There is therefore a need to provide articles of warmth with an improved battery support means which can overcome the above noted inconveniences.

SUMMARY OF THE INVENTION

It is a feature of the present invention to provide an electrically heated article of warmth having an integrally formed pocket for the placement and retention of one or more batteries at desired locations and battery orientations and which substantially overcomes all of the abovementioned disadvantages of the prior art.

Another feature of the present invention is to provide an electrically heated article of warmth wherein an integrally formed large and concealed hollow battery retention pocket is formed between an outer shell of the article of warmth and an inner liner to define a hollow space wherein the opposed faces of the space are microfiber materials which bind together when placed in contact to prevent the displacement of batteries positioned therein. The present invention allows for each battery, of various sizes and shapes, to be retained in a pocket at virtually unlimited orientations and position arrangements.

A further feature of the present invention is to provide an electrically heated article of warmth having a large pocket formed therein and concealed from the outer surface of the article of warmth thereby not impeding on the fashionable external appearance of the article of warmth.

A still further feature of the present invention is to provide an electrically heated article of warmth formed with a large pocket concealed from the outer surface of the article and wherein the pocket has at least one inner surface thereof formed with microfibers having loops or hook fibers to receive and retain one or more batteries provided with an external binding material having the opposed binding fibers of the loops or hooks to attach to the inner surface when positioned in contact therewith.

A still further feature of the present invention is to provide an electrically heated jacket or vest having at least one integrally formed with concealed battery support pocket space wherein the article of apparel can be worn with or without batteries without affecting the external fashionable appearance of the article.

Another feature of the present invention is to provide an electrically heated article of apparel having an integrally formed concealed large battery support pocket wherein one or more batteries can be positioned at desired positions and orientation in the pocket for the comfort of the wearer person to suite the person's body shape or weight distribution of the batteries or for accommodating a sport activity or job function of the user person.

A further feature of the present invention is to provide an electrically heated article of apparel having an integrally formed large concealed pocket formed in a composite material article and wherein the pocket defines a hollow space having opposed material inner surfaces and wherein one or both inner surfaces have binding microfibers or binding rubber or other sticky material surfaces to retain one or more batteries positioned therein at desired positions and orientations and wherein the composite materials includes one or combinations of cushion padding, for comfort and battery protection; extra resistant material against ripping from sharp objects, such as Kevlar, Registered trademark, for battery protection; fireproofing fabrics, static proof fabrics, waterproof fabrics and thermal insulating fabrics.

Another feature of the present invention is to provide the user person a pocket structure wherein the battery(les) can be positioned at the most convenient and comfortable place and orientation. The position of batteries will differ according to the numbers of battery required by the user person. It may be advantageous to position the batteries in order to balance weight distribution and optimize comfort. Accordingly, the position of a battery might be at a different place for one person to another, depending on the gender, body shape and the activity for which the user intends to practice (perform), while wearing the heated garment. For example, it could be uncomfortable or even dangerous to place the battery in one particular position while doing horseback riding and another place might be more suitable for the same person practicing another activity, such as golfing. The feature of adjusting the battery position and location in a simple and user-friendly way and giving multiple, almost unlimited, position options to the user person is an incredible advantage over a fixed location and angle, such as what is currently offered in all heated garments.

According to the above features, from a broad aspect, the present invention provides an electrically heated article of warmth adapted to generate heat to a user person's body. The article of warmth has at least one integrally formed pocket to support and conceal one or more batteries at desired locations and orientations therein for the comfort of the user person. The pocket is formed between opposed fabric materials interconnected to one another to define a hollow concealed pocket space to receive and position the one or more batteries therein. An opening is formed in one of the opposed fabric materials for access to the hollow concealed pocket space. The opposed fabric materials have an inner surface facing one another in the hollow concealed pocket space. The inner surfaces have connecting fibers which when the inner surfaces are placed against one another they exhibit a binding retention force. The one or more batteries are retained at the desired locations and orientations by the retention force of the connecting fibers of the inner surface of the opposed fabric materials being placed in contact with one another and surrounding the one or more batteries.

According to another broad aspect of the present invention there is provided an electrically heated article of warmth adapted to generate heat to a user person's body. The article of warmth is comprised of at least one integrally formed pocket to support and conceal one or more batteries at desired locations and orientations therein for the comfort of the user person. The pocket is formed between opposed fabric materials interconnected to one another to define a hollow concealed pocket space to receive and position the one or more batteries therein. An opening is provided in one of the opposed fabric materials for access to the hollow concealed pocket space. The opposed fabric materials have an inner surface facing one another in the hollow concealed pocket space. A least one of the inner surfaces is formed with connecting microfibers for binding retention and removable attachment of one or more batteries on which is secured a fiber connecting material for releasable attachment to the connecting microfibers of the at least one of the inner surfaces.

According to a still further broad aspect of the present invention there is provided an electrically heated article of warmth adapted to generate heat to a user person's body. The article of warmth comprises at least one integrally formed pocket to support and conceal one or more batteries at desired locations and orientations therein for the comfort of the user person. The pocket is formed between an outer and an inner fabric material of the article of warmth interconnected to one another to define a hollow concealed pocket space between opposed inner surfaces of the outer and inner fabric materials. The inner fabric material has a flap section for access to the inner surface of the outer fabric material of the hollow concealed pocket space. The inner surface of the outer fabric material defines a battery retaining section. The battery retaining section has a sticky surface which exhibits a binding retention force with a further sticky surface provided on an inner surface of the flap section or on a surface of the one or more batteries provided with a sticky surface. The one or more batteries are retained at the desired locations and orientations by the retention force created by the opposed sticky surfaces of the opposed inner surfaces of the outer and inner fabric materials being placed in contact with one another or the sticky surface of the one or more batteries positioned against the sticky surface of the inner surface of the outer fabric material.

BRIEF DESCRIPTION OF THE DRAWING

A preferred embodiment of the present invention will now be described with reference to the accompanying drawings in which.

DESCRIPTION OF THE PREFERRED EMBODIMENT

Before any embodiments of the application are explained in detail, it is to be understood that the application is not limited to the details of construction and the arrangement of component part set forth in the following description or illustrated by the following drawings. Further, it is to be understood that the phraseology and terminology used herein is for the purpose of description and should not be regarded as limiting but should encompass equivalents thereof.

Figure 1A:
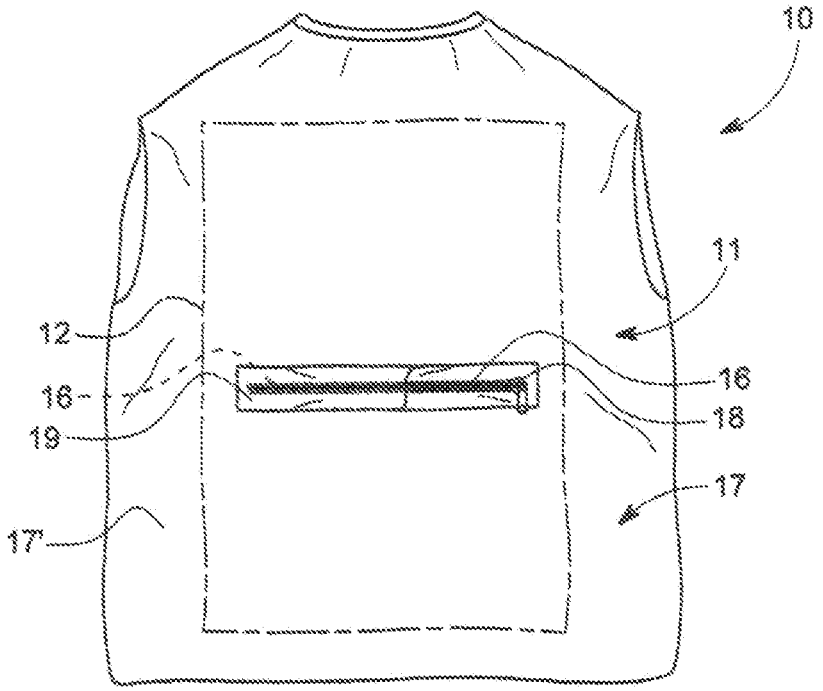
FIG. 1A is a rear view of a vest article of apparel showing the position of a large pocket integrally formed therein and accessible through a concealed opening for the position and retention of one or more batteries therein.
Figure 1B:
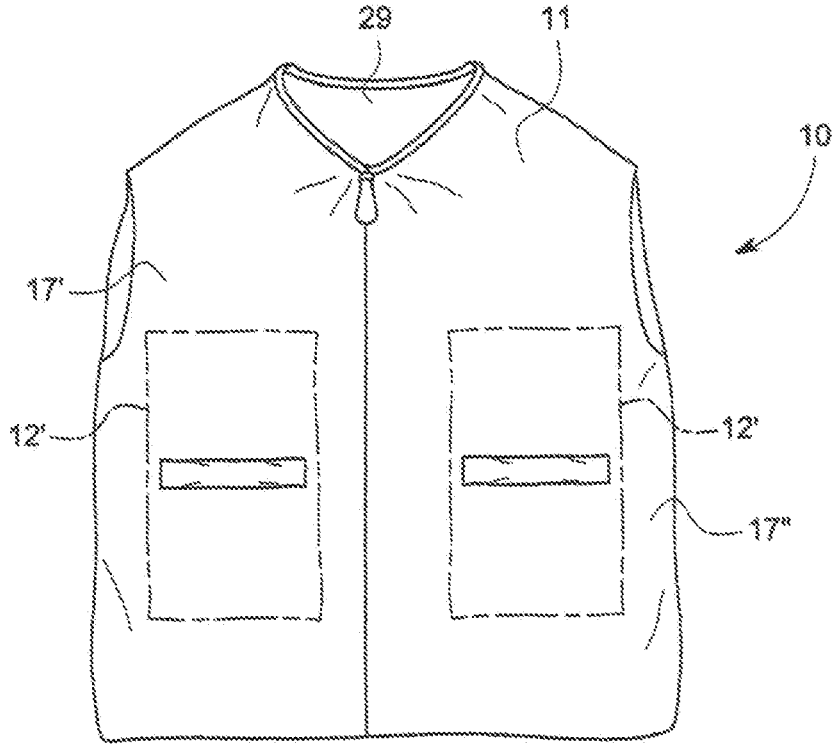
FIG. 1B if a front view of the vest article of apparel shown in FIG. 1 and wherein there is shown that large pockets may also be integrally formed in the front panels of the article.
Figure 2:
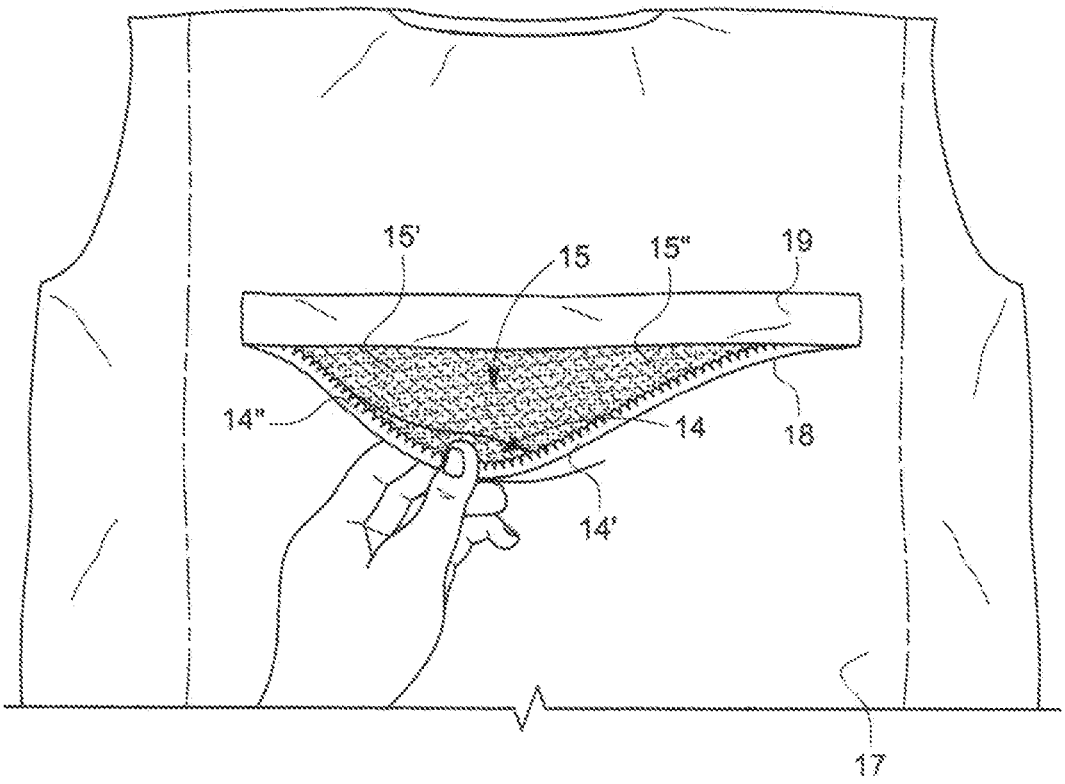
FIG. 2 is a fragmented view showing the access to the large conceal hollow pocket space and the microfiber binding inner surfaces of the pocket.
Figure 3:
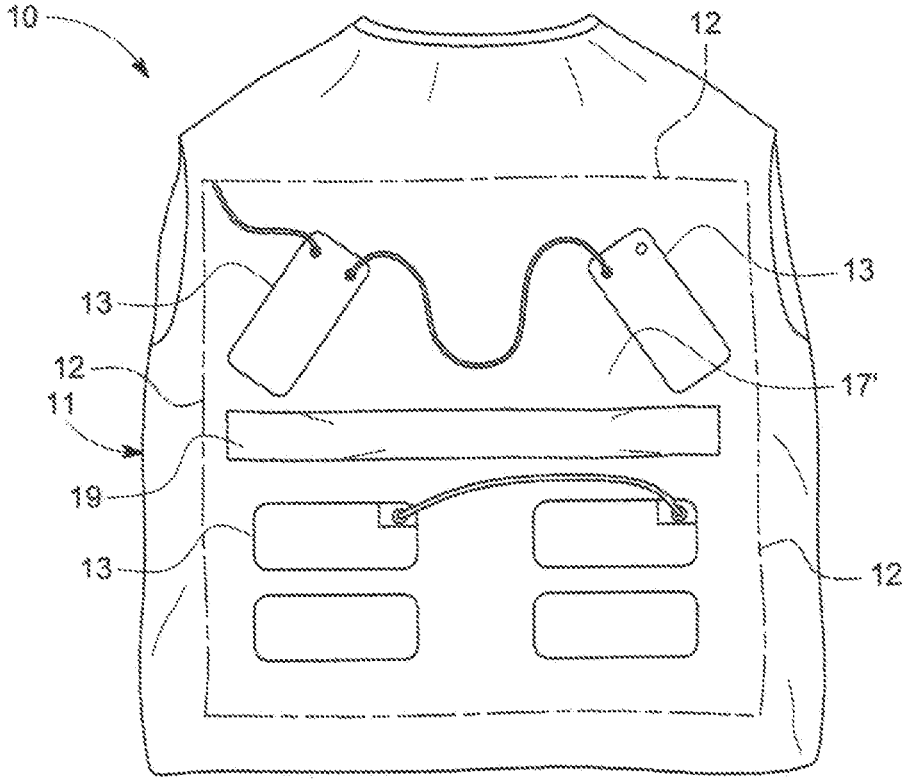
FIG. 3 is a rear view of a back panel of an article of apparel and which illustrates batteries of different sizes and orientations retained inside the large pocket by the binding microfibers.

Referring now to the drawings and more particularly to FIGS. 1 to 3 there is shown generally at 10 an electrically heated article of warmth, herein a vest 11 adapted to generate heat to a user person's upper body. The vest 11 has an integrally formed large pocket 12 which is concealed from view to support one or more batteries 13 at desired locations and orientations therein, as shown in phantom lines in FIG. 3, for the comfort of the user person. The pocket 12 is a hollow pocket formed between opposed inner fabric materials 14 and 15, that when placed against one another bind together due to their material compositions to create a retention force which can be separated by pulling the fabrics apart by the use of the wearer person's hands to create an opening for the placement and orientation of one or more batteries.

As shown in FIG. 1A, a slit opening 16 is formed in the back panel 17' of the outer fabric shell 17 of the vest 11 and provided with a zipper fastener 18 for access to the inner hollow space of the pocket 12. A fabric flap 19, matching the outer fabric shell material conceals the zipper fastener 18 from view. Similarly, pockets 12' may be provided in one or both front panels 17" of the vest 11 as shown in FIG. 1B, to conceal batteries 13 therein. The slit opening 16 and zipper fastener could also be provided in the inner liner fabric material for access to the pocket and concealed from the outer side of the article of apparel not to intrude on the outer aesthetic appearance of the article of apparel.

As shown in FIG. 2 the opposed fabric materials 14 and 15 have binding interconnecting microfibers formed in their opposed inner surfaces which when placed against one another exhibit a retention force, much like the connecting fibers of the VELCRO, Registered Trademark, connector materials. However, the microfiber materials utilized in the present pocket construction have opposed surfaces which are smooth and silk-like to the touch, unlike that of VELCRO which is a stiff material. Also, the microfiber fabrics are highly flexible and conform to the shape of the shell and the inner lining of the vest 11. The microfiber material inner surface 14', of the outer fabric shell 17, is herein constituted by a fiber structure, similar to cotton fibers, and forming loop attachments 14". The opposite microfiber material of the inner surface 15' of the inner liner 29 is formed of extra-fine microfibers forming hooks 15". There are over 1 million such hook microfibers 15" per sq/inch in the inner surface 15' and approximately 95,000 loop microfibers 14" per sq/inch in the cotton-like inner surface 14' of the outer fabric. It is pointed out that the inner surface 14' could be formed of the hook microfibers and the inner surface 15' of loop microfibers which perform the same binding sticky function to retain one or more batteries therebetween. The opposed inner surfaces 14' and 15' of the pocket 12 bind together when the pocket is not provided with batteries to maintain the natural draping look of the fabric due to the smooth and flexible nature of the microfibers. As mentioned above, the pocket is opened by unzipping the opening 11 and pulling apart the inner surfaces, as shown in FIG. 2, to release their sticky retention force to create an open space therebetween for the placement of batteries at desired positions.

Figure 5A:
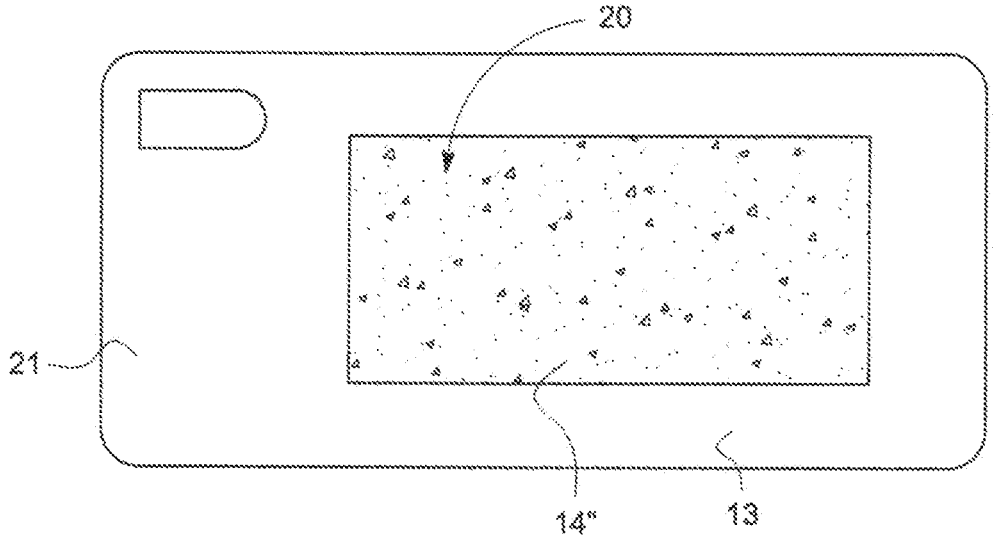
FIG. 5A is a plan view of a battery provided with a patch of binding fiber material for binding connection with an inner microfiber surface of the battery supporting pocket.
Figure 5B:
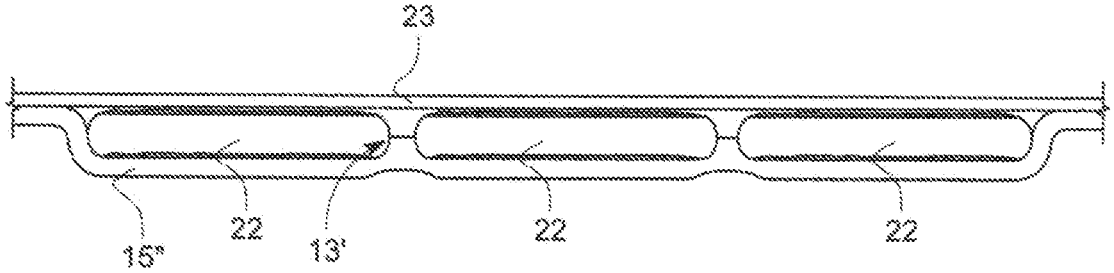
FIG. 5B is a transverse section view showing three battery cells interconnected together and having an entire surface of the cells provided with a binding material there across.

As shown in FIGS. 5A and 5B, in order to assure excellent battery retention between the opposed binding microfibers inner surfaces 14' and 15', the batteries are provided with a fiber connecting material patch 20 secured to at least a portion of a flat surface 21 thereof. The fiber connecting patch 20 could consist of one of the microfiber materials 14" or 15" which is of opposite microfiber material (hook or loop microfibers) to the surface to which it is to be applied against, usually the inner surface 15' on the liner side of the pocket. To identify the matching fabric for the patch 20, the patch could also be made of a color complimentary to a color of the inner surface of the pocket to which it is to be coupled to. Other code matching means may also be provided to achieve the same result. Also, the patch 20 could cover the entire surface 21 of the battery 13.

FIG. 5B illustrates the construction of a flexible battery 13', wherein three battery cells 22 are interconnected together by a flat flexible membrane 23 glued to one side of the three battery cells. The opposite side is herein shown with a microfiber material, preferably but not exclusively the finer hook microfiber material 15", glued entirely over the surface 21 of the three cells 22 or entirely around the flexible battery opposed surfaces. Such a separated cell battery construction is thinner and flexible and therefore more comfortable to the wearer person by adapting to curved shapes of the wearer person's body.

Figure 4:
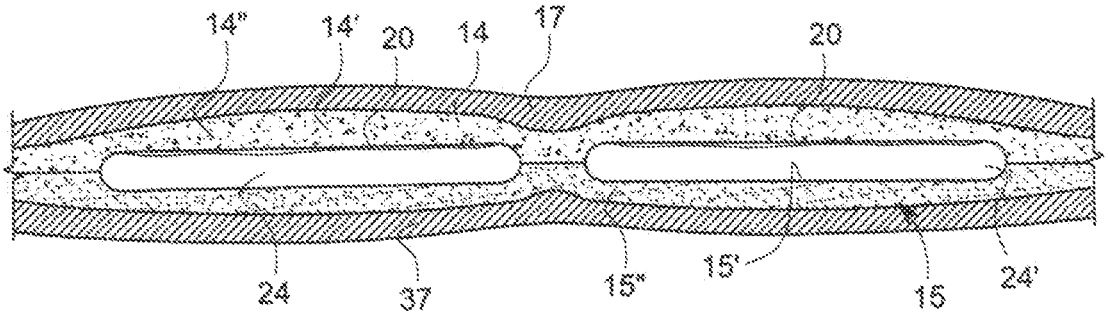
FIG. 4 is a cross-sectional view illustrating two batteries held in position by the binding microfibers.
Figure 7:
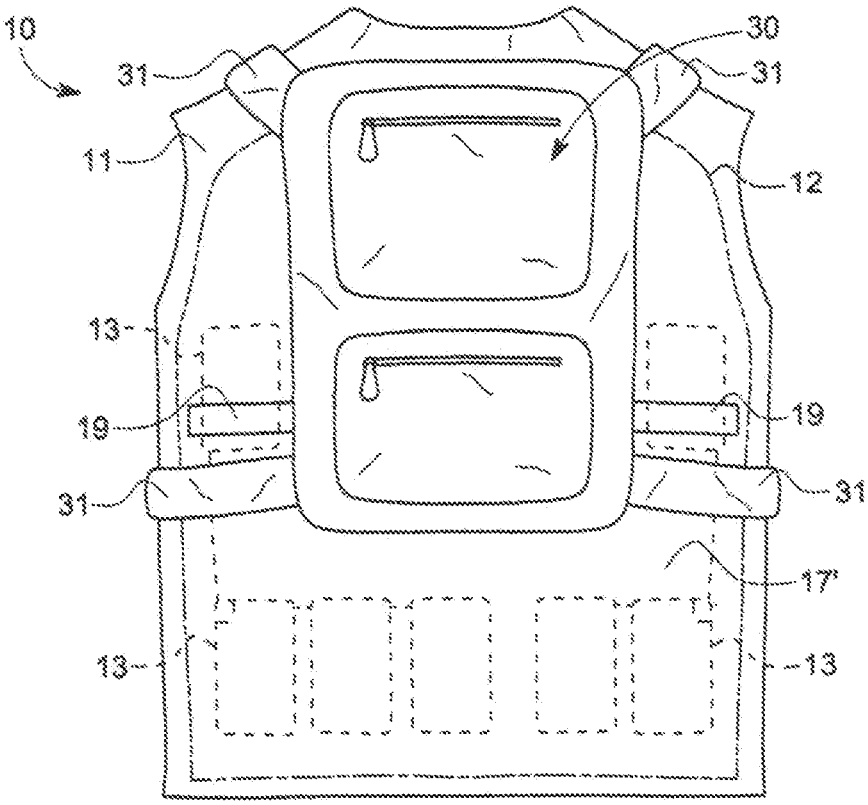
FIG. 7 is a rear view of an electrically heated article of apparel wherein the rear panel of the article is formed with a concealed large pocket and wherein the batteries are shown disposed at positions and orientations to accommodate a backpack supported on the wearer person's back.

As shown in FIG. 4, two batteries 24 and 24' are shown electrically connected to one another and held captive between the opposed microfiber surfaces 14" and 15" which are interconnected together all around the two batteries by their hook and loop fiber surfaces as well as to the battery patches 20 to retain the batteries in position therebetween, at desired locations and orientations as determined by the wearer person for its comfort adapting to the activity or occupation or body size of the user person or to accommodate the position of articles to be attached or supported exteriorly over the outer surface of the article of apparel. For example, as shown in FIG. 7, the batteries 13 are oriented at positions not to interfere with a backpack 30 and strapping 31 to be supported on the wearer person's back. Although not shown, the control for the batteries may be mounted at a convenient location on one of the front panels 17" in a visible mounting or a concealed mounting as described in my co-pending patent application Ser. No. 17/581,891, filed on Jan. 22, 2022. The article of apparel herein illustrated is that of a vest, but it is pointed out that such article of warmth may be a jacket, pants, a sleeping bag and other articles of warmth which are electrically heated and for use to warm a wearer person. Also, the pocket may be formed entirely throughout the back panel 17' or entirely throughout one or both frontal panels 17", or parts thereof. Although FIGS. 3 and 7 illustrate the batteries 13 oriented in a vertical or horizontal position, these may be positioned at any angular position within the pocket as the positioning is made by inserting the batteries with a person's hand which may be only partly visible or not visible when in a large pocket. Also, an angular position may be warranted due to the desired comfort of the user person or the adaptability to a sport activity or any other work or pleasure activity of the user person, as mentioned above.

Figure 6:
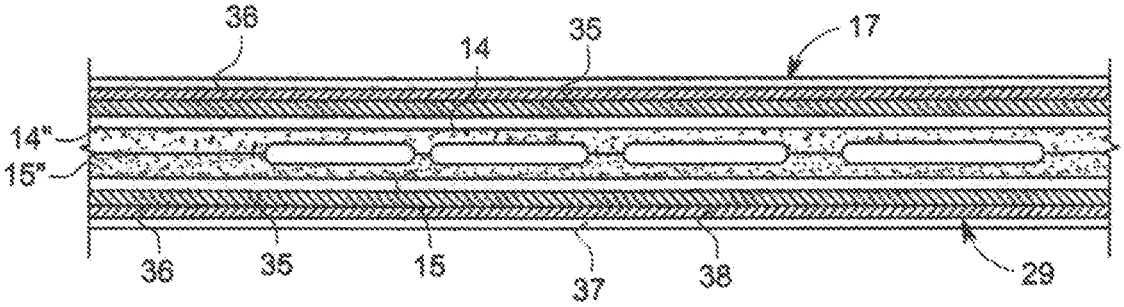
FIG. 6 is a further transverse cross-sectional view showing batteries of different sizes retained in the pocket with the opposed material composition of the article of warmth being formed with composite material layers.
Figure 10:
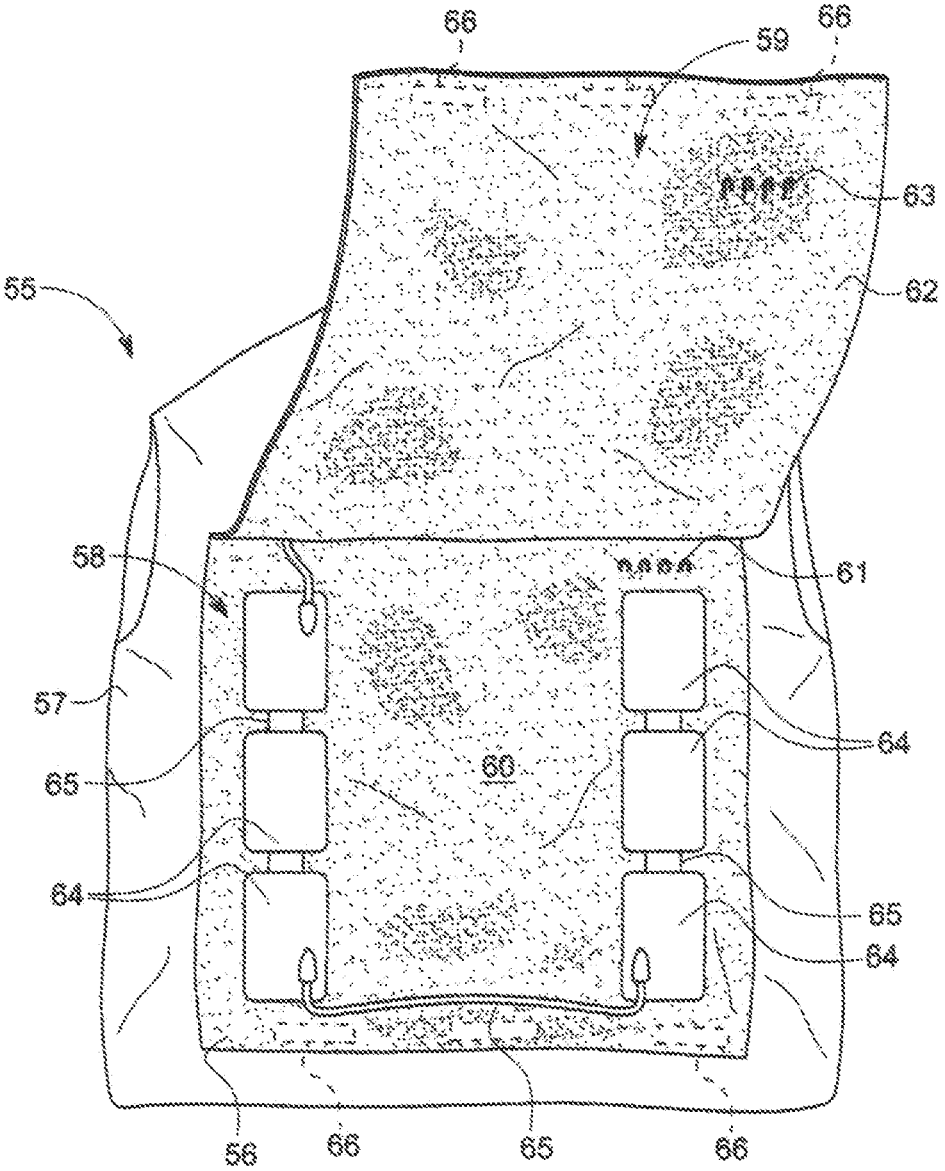
FIG. 10 is an inner view of a vest showing the inner surface of the back panel and wherein the inner liner has a large flap formed therein for access to the concealed pocket to expose the inner surface of the outer fabric shell which is provided with a sticky surface material to retain one or more batteries thereon in a concealed manner.

As illustrated in FIG. 6, the outer fabric shell 17 and the inner liner fabric 29 may be composed of different fabric layers to constitute composite fabric materials. For example, both the outer shell 17 and the inner liner 29 may include a fireproof lining fabric 35 bonded there behind to protect against battery fire. A static shielding fabric layer 36 could also be included in the composite fabric outer shell and liner composite fabric. The outer shell may also be formed of waterproof materials of types well known in the art. The inner fabric liner material sheet 37 may also have a moisture absorbing sheet material also having insulating properties secured there behind. Depending on the intended use of the article or warmth an insulating or cushioning sheet material or a KEVLAR, Registered Trademark, sheet material may be included in the composite outer shell and/or inner fabric liner or any desirable composition of the above. Because there is only one or a few large pockets, this also facilitates the fabrication of the article of warmth. As shown in FIG. 10, small connector cables are installed inside the pocket with sufficient cable length to permit connection(s) to the batteries disposed within the pocket at various desired locations and orientations.

Figure 8A:
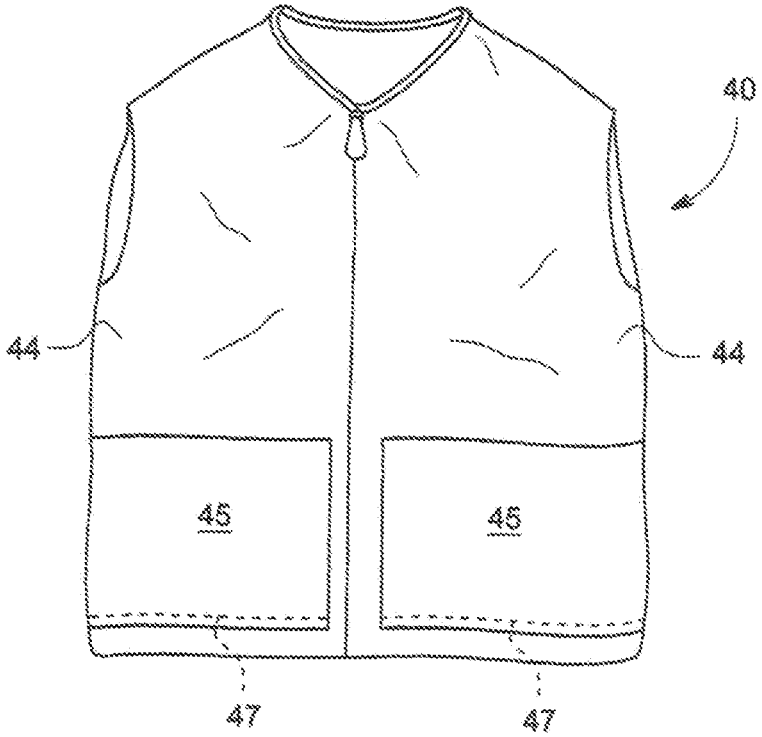
FIGS. 8A and 8B shows a vest and wherein a large concealed pocket extends into the back panel of the vest and into the opposed frontal panels and with access thereto is provided by zipper closures for entry into the hollow space of the sections of the pocket.
Figure 8B:
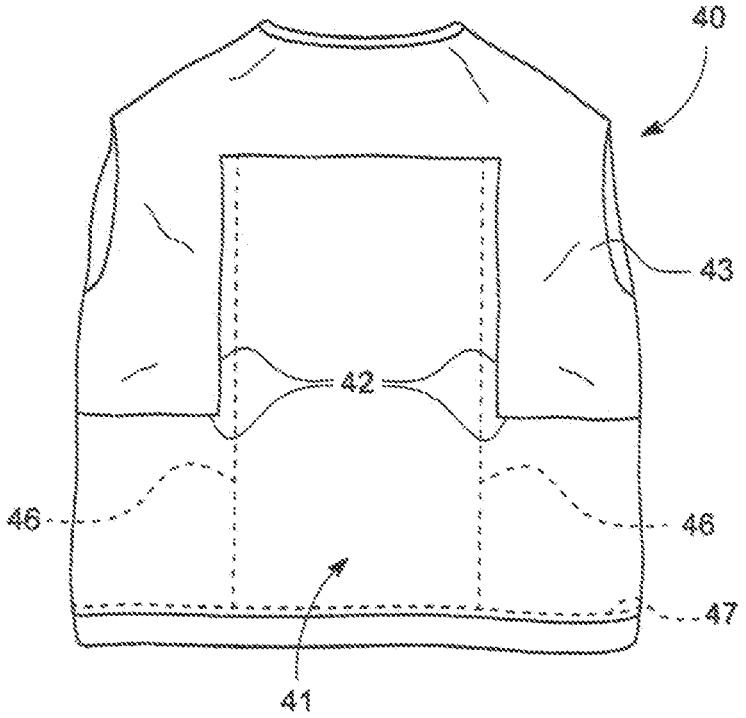

Referring now to FIGS. 8A and 8B, there is shown a vest 40 in which there is formed a very large concealed pocket 41 constituted by a rear pocket section 42 extending into the back panel 43 and converging into the lower section of the frontal panels 44 to form two frontal pocket sections 45. In order to provide access to the pocket sections 42 and 45, zipper closures 46 may be provided on opposed vertical sides of the rear pocket section 42 to provide access thereto from opposed sides to facilitate the separation of the microfiber inner surfaces which are stuck together and to also facilitate entry into the frontal pocket sections 45. Alternatively, a zipper closure 47 may be provided in the lower edge of the pocket sections to provide access to the hollow pocket sections, particularly so if only one of the opposed inner surfaces has a sticky surface material thereby facilitating easy access to the top section of the rear pocket section.

Figure 9A:
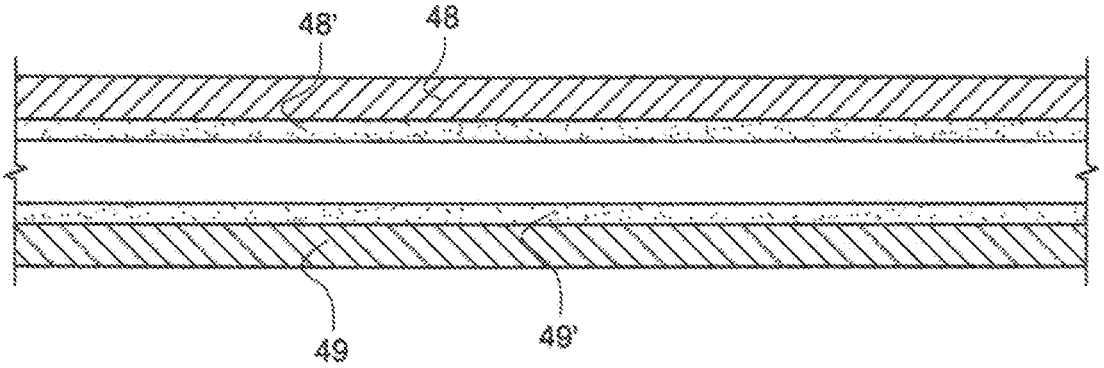
FIG. 9A is a cross-sectional view of the fabric in which the pocket is formed, herein illustrating an outer fabric shell and a liner having opposed inner surfaces provided with microfiber material with one inner surface having hook microfibers and the other inner surface having hook microfibers.

FIG. 9A illustrates a pocket construction wherein the opposed fabric materials of the article of warmth is formed with an outer fabric shell 48 provided with an inner surface 48' formed of hook microfibers. The opposed liner fabric 49 also has an inner surface 49' formed of loop microfibers. In this embodiment the opposed surface bind together when placed in contact and exhibit a retention force which is separated by pulling apart the outer fabric shell from the inner liner by a force overcoming the binding force of the microfibers.

Figure 9B:
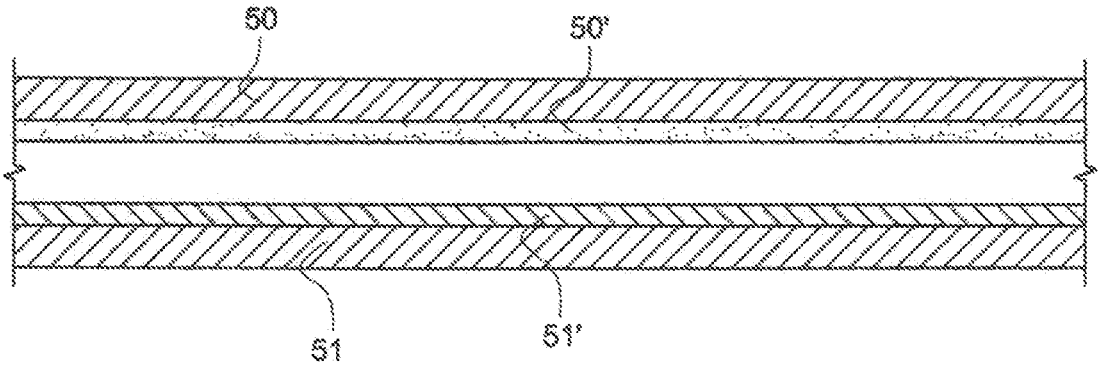
FIG. 9B is a view similar to FIG. 9A but wherein one of the inner surfaces is provided with microfiber material and the opposite inner surface with a non-sticky material.

FIG. 9B illustrates a pocket construction wherein the opposed fabric materials of the article of warmth is formed with an outer fabric shell 50 provided with an inner sticky surface 50' formed of sticky microfibers or a sticky rubber coating to receive and retain one or more batteries thereon provided with a sticky patch, as shown in FIG. 5, and formed of microfibers of different binding fibers than those of the outer shell inner surface 50' or sticky rubber. The opposed liner fabric 51 has an inner surface 51' formed of a non-sticky surface whereby not to bind to the inner sticky surface 50' of the outer fabric shell 50. This construction of the inner surfaces of the concealed pocket facilitates entry and access to the entire concealed pocket(s).

Referring now to FIG. 10 there is illustrated another embodiment of the present invention, herein a vest 55 in which a large concealed pocket 58 is formed between the rear fabric panel 56 and the inner liner material 57. The concealed pocket 58 is made accessible by a large flap 59 formed in the inner liner material and hinges upwardly for access to the interior of the pocket 58 to expose the inner surface 60 of the rear fabric panel 56, which is herein illustrated provided with loop microfibers 61. The inner surface 62 of the flap 59 is also formed with microfiber material and wherein the microfibers are hook microfibers 63 to bind with the loop microfibers 61 when the flap is in its closed position against the rear fabric panel 56. With this embodiment, the flap 59 is separated from the inner surface 60 of the outer shell and the vest is placed flat on a support surface with the microfiber inner surface 60 exposed to permit the placement of one or more batteries 64 and interconnecting wiring 65 at desired locations and orientations, as herein illustrated. Thereafter, the flap is placed in a closed position over the inner surface 60 and the batteries and pressed thereon about the batteries to retain the batteries 64 captive between the opposed inner surfaces 60 and 62 with the flap maintained in a closed condition. Small VELCRO, registered trademark, patches 66 and 66 may be secured to the inner surface of the flap 59 and the inner surface 60 of the of the rear fabric panel 56 to provide added retainment of the flap 59.

With the embodiment of FIG. 10, another choice of construction is to provide the batteries with sticky material microfibers in the form of a patch, as shown in FIG. 6, or a sticky coating which will bind to the loop microfibers 61 of the inner surface 60. The inner surface 62 of the large flap 59 of the inner liner would not require binding microfibers therefore providing an easier access to the concealed pocket due to the fact that it would not be required to pull-apart interconnected microfibers between the inner surface 60 of the outer shell and the inner surface 62 of the flap 59. However, to retain the flap in a closed position Velcro patches 66, or small patches of binding microfibers, may be secured at different locations on the inner surfaces 60 and 62. Other form of retention means for the flap may also be contemplated. An advantage of providing access to the pocket from the interior liner of the article of warmth is that the aesthetic of the outer surface of the article is not modified with zipper closures concealed by flaps, etc., for access to the concealed pocket.

Many other modifications and other embodiments of the present invention as described above will come to mind to a person skilled in the art to which the invention pertains having the benefit of the teachings described herein above and the drawings. Hence, it is to be understood that the embodiments of the present invention are not to be limited to the specific examples thereof as described herein and other embodiments are intended to be included within the scope of the present invention and the appended claims. Although the foregoing descriptions and associated drawings describe example embodiments in the context of certain examples of the elements and members and/or functions, it should be understood that different combinations of elements or substitutes and/or functions may be provided by different embodiments without departing from the scope of the present invention as defined by the appended claims. Furthermore, although specific terms are employed herein, they are used in a generic and descriptive sense only and other equivalent terms are contemplated herein with respect to the items that they relate to. It is therefore within the ambit of the present invention to encompass all obvious modifications of the examples of the preferred embodiment described herein provide such modifications fall within the scope of the appended claims.

The invention claimed is:

1. An electrically heated article of warmth adapted to generate heat to a user person's body, said article of warmth comprising at least one integrally formed pocket having a dimension to support and conceal one or more batteries at desired locations and orientations therein as determined by said user person for the comfort of said user person, said pocket being formed between opposed fabric materials interconnected to one another to define a hollow concealed pocket space to receive and position said one or more batteries therein, an opening in one of said opposed fabric materials for access to said hollow concealed pocket space, said opposed fabric materials each defining an inner surface facing one another in said hollow concealed pocket space, one of said inner surfaces of said opposed fabric materials being formed entirely of a sticky material which exhibits a binding retention force when positioned against a further binding surface provided entirely on the other of said inner surfaces, said one or more batteries being retained at said desired locations and orientations by said binding retention force created by said opposed binding surfaces being placed in contact with one another adjacent peripheral edges of said one or more batteries.

2. The electrically heated article of warmth as claimed in claim 1 wherein said sticky surface of said one of said inner surfaces and said further binding surface is constituted by connecting fibers, said connecting fibers of said one and said further surfaces being one of loops or hooks type fibers wherein said hooks type fibers in one of said one and said further surface will releasably stick or attach to said loops in the other of said one and said inner surfaces.

3. The electrically heated article of warmth as claimed in claim 2 wherein said connecting fibers are comprised of microfibers formed with said loops and said hooks microfibers.

4. The electrically heated article of warmth as claimed in claim 3 wherein said further binding surface is constituted by the other of said opposed fabric materials.

5. The electrically heated article of warmth as claimed in claim 2 wherein said one or more batteries have opposed flat surfaces, a fiber adhering material secured to at least a portion thereof for removable attachment to said one of said inner surfaces of said opposed fabric materials.

6. The electrically heated article of warmth as claimed in claim 1 wherein said fiber adhering material completely surround said one or more batteries.

7. The electrically heated article of warmth as claimed in claim 5 wherein said fiber adhering material secured to said one or more batteries is one of a VELCRO, Registered Trademark, adhering material patch formed of one of hooks and loops fibers, a microfiber material formed of one of hooks and loops fibers, and a sticky rubber material.

8. The electrically heated article of warmth as claimed in claim 5 wherein said identification means is constituted by a color matching identifier wherein one of said inner surfaces has a color complimentary to a color of said fiber adhering material secured to at least a portion of one of said opposed flat surfaces of said one or more batteries to establish an interconnection match.

9. The electrically heated article of warmth as claimed in claim 1 wherein said at least one pocket is integrally formed in a dedicated area of said article of warmth, and a slit opening formed in one of said opposed fabric materials for access to said hollow concealed pocket space.

10. The electrically heated article of warmth as claimed in claim 9 wherein a zipper fastener is secured to said slit opening to provide access and closure to said hollow concealed pocket space.

11. The electrically heated article of warmth as claimed in claim 10 wherein said opening is formed in one of an outer and an inner one of said opposed fabric materials.

12. The electrically heated article of warmth as claimed in claim 1 wherein said article of warmth is one of a jacket, a vest, pants, a sleeping bag and other articles of warmth which are electrically heated and for use to warm a wearer person.

13. The electrically heated article of warmth as claimed in claim 1 wherein said article of warmth is one of a jacket or vest, said at least one pocket being formed in substantially all of a complete back panel of said jacket or vest and/or one or two of complete front panels of said jacket or vest or a combination thereof.

14. The electrically heated article of warmth as claimed in claim 13 wherein said one or more batteries are positioned at selected positions within said at least one pocket for the comfort of said user person, said selected positions being determined by the activity or occupation or body size of said user person or to accommodate the position of articles to be attached or supported exteriorly over said article of warmth in the region of said pocket.

15. The electrically heated article of warmth as claimed in claim 3 wherein said opposed fabric materials defining said hollow concealed pocket space are constituted by an outer fabric shell material having an inner surface material sheet secured thereto and formed of one of said microfibers formed with fiber loops and an inner lining fabric having an inner surface facing said inner surface of said outer fabric shell and formed with an opposite one of said fiber loops or hook microfibers of said outer fabric shell.

16. The electrically heated article of warmth as claimed in claim 15 wherein said opposed fabric materials are composite fabric materials including one or a combination of a fireproof material, a static proof fabric material, an insulating or cushioning sheet material, and a KEVLAR, Registered Trademark, sheet material.

17. The electrically heated article of warmth as claimed in claim 5 wherein said further binding surface is the other of said inner surface facing said one of said inner surfaces, both said inner surfaces being microfiber surfaces having like ones of hooks or loops binding microfibers, said microfibers adhering material secured to said one or more batteries being an opposed one of said hooks and loops binding microfibers of said opposed inner surfaces of said hollow concealed pocket space.

18. The electrically heated article of warmth as claimed in claim 2 wherein said opposed inner surfaces of said pocket bind together when said pocket is not provided with said one or more batteries, said inner surfaces of said pocket being pulled apart with sufficient pulling force to release their retention force to create an open space therebetween for the placement of said one or more batteries.

19. The electrically heated article of warmth as claimed in claim 3 wherein said microfibers in an inner surface of one of said opposed fabric materials is comprised of extra fine microfibers and the other having cotton-like size microfibers and wherein when said opposed inner surfaces are in contact with one another they perform a sticky interconnection retention force.

20. An electrically heated article of warmth adapted to generate heat to a user person's body, said article of warmth comprising at least one integrally formed pocket to support and conceal one or more batteries at desired locations and orientations therein for the comfort of said user person, said pocket being formed between opposed fabric materials interconnected to one another to define a hollow concealed pocket space to receive and position said one or more batteries therein, an opening in one of said opposed fabric materials for access to said hollow concealed pocket space, said opposed fabric materials having an inner surface facing one another in said hollow concealed pocket space, at least one of said inner surfaces being formed with one of connecting microfibers and sticky rubber for retention and removable attachment of one or more batteries provided with a connecting material for releasable attachment to said one of connecting microfibers and sticky rubber of said at least one of said inner surfaces.

21. The electrically heated article of warmth as claimed in claim 20 wherein both of said inner surfaces are provided with connecting microfibers, one of said opposed inner surfaces being comprised of microfibers formed with loop microfibers and the other of said opposed inner surfaces formed with hook microfibers.

22. The electrically heated article of warmth as claimed in claim 21 wherein said one or more batteries have opposed flat surfaces, a fiber connecting material is secured to at least a portion of one of said opposed flat surfaces of said one or more batteries, and identification means to identify a designated one of said microfiber inner surfaces to which said fiber connecting material of said battery is to be disposed against for attachment.

23. The electrically heated article of warmth as claimed in claim 22 wherein said fabric connecting material is formed by one of said connecting microfibers of said opposed inner surfaces and a hook or loop VELCRO binding material.

24. The electrically heated article of warmth as claimed in claim 20 wherein said at least one of said inner surfaces is provided with loop microfibers, the other of said inner surfaces being free of connecting microfibers, said one or more batteries having opposed flat surfaces and wherein at least a portion of one or both said surfaces is provided with hook microfiber material secured thereto for releasable attachment to said connecting microfibers of said at least one of said inner surfaces.

25. The electrically heated article of warmth as claimed in claim 20 wherein both said opposed inner surfaces are provided with connecting microfibers formed with like loop microfibers, said one or more batteries having opposed flat surfaces and wherein at least a portion of one or both said surfaces is provided with hook microfiber material secured thereto for releasable attachment to said connecting microfibers of at least one of said inner surfaces.

26. The electrically heated article of warmth as claimed in claim 25 wherein both said inner surfaces of said one or more batteries are provide in at least a portion thereof with hook microfibers for releasable attachment to said loop microfibers of both said opposed inner surfaces.

27. An electrically heated article of warmth adapted to generate heat to a user person's body, said article of warmth comprising at least one integrally formed pocket to support and conceal one or more batteries at desired locations and orientations therein for the comfort of said user person, said pocket being formed between an outer and an inner fabric material of said article of warmth interconnected to one another to define a hollow concealed pocket space between opposed inner surfaces of said outer and inner fabric materials, said inner fabric material having a flap section for access to said inner surface of said outer fabric material of said hollow concealed pocket space, said inner surface of said outer fabric material defining a battery retaining section, said battery retaining section having a sticky surface which exhibits a binding retention force with a further sticky surface provided on an inner surface of said flap section or on a surface of said one or more batteries provided with a sticky surface, said one or more batteries being retained at said desired locations and orientations by said retention force created by said opposed sticky surfaces of said opposed inner surfaces of said outer and inner fabric materials being placed in contact with one another or said sticky surface of said one or more batteries positioned against said sticky surface of said inner surface of said outer fabric material.

28. The electrically heated article of warmth as claimed in claim 27 wherein said sticky surface of said battery retaining section is provided by connecting fibers of one of hook or loop type connecting fibers, said further sticky surface of said inner surface of said flap section being provided with an opposite one of said hook or loop type connecting fibers of said battery retaining section, said one or more batteries being retained between said battery retaining section and said further sticky surface of said fabric flap section when disposed in interconnecting contact with one another.

29. The electrically heated article of warmth as claimed in claim 27 wherein said flap section provides an access opening to said sticky surface of said outer fabric material for exposing said battery retention section to permit said one or more batteries to be disposed thereon when said outer fabric material is laid flat on a support surface to position one or more batteries thereon at desired locations and orientations, said one or more batteries being retained between said sticky surface of said opposed inner surfaces when said flap section is laid flat over said sticky inner surface of said outer fabric material and pressed thereagainst to cause said opposed sticky surface to bind together to create a retention force about said one or more batteries to hold said one or more batteries in position.

30. The electrically heated article of warmth as claimed in claim 29 wherein said sticky surfaces are constituted by one of loop and hook microfiber material, one of said opposed inner surface having loop microfibers and the other having hook microfibers.

31. The electrically heated article of warmth as claimed in claim 27 wherein said sticky surface of said battery retaining section and said flap section is provided by sticky rubber flexible binding material.

* * * * *